US007878119B2

(12) United States Patent
Grove et al.

(10) Patent No.: US 7,878,119 B2
(45) Date of Patent: Feb. 1, 2011

(54) PERFORATING CHARGE FOR USE IN A WELL

(75) Inventors: Brenden M. Grove, Missouri City, TX (US); Andrew T. Werner, East Bernard, TX (US); Philip Kneisll, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/817,538

(22) Filed: Jun. 17, 2010

(65) Prior Publication Data

US 2010/0251878 A1 Oct. 7, 2010

Related U.S. Application Data

(62) Division of application No. 11/559,243, filed on Nov. 13, 2006, now Pat. No. 7,762,193.

(60) Provisional application No. 60/736,516, filed on Nov. 14, 2005.

(51) Int. Cl.
*F42B 1/028* (2006.01)
*F42B 1/032* (2006.01)
*F42B 1/036* (2006.01)

(52) U.S. Cl. ..... 102/307; 102/306; 102/308; 102/309; 102/310; 102/476; 89/1.15

(58) Field of Classification Search ..... 102/476, 102/306–310; 89/1.15
See application file for complete search history.

(56) References Cited

U.S. PATENT DOCUMENTS 218,282 A * 8/1879 La Foy ..... 277/341
3,224,368 A * 12/1965 House ..... 102/306
4,702,171 A * 10/1987 Tal et al. ..... 102/476
4,922,825 A * 5/1990 Aubry et al. ..... 102/476
5,792,977 A * 8/1998 Chawla ..... 102/307
6,021,714 A * 2/2000 Grove et al. ..... 102/307
6,223,656 B1 * 5/2001 Glenn ..... 102/306
6,588,344 B2 * 7/2003 Clark et al. ..... 102/307
6,786,157 B1 * 9/2004 Powell ..... 102/476
6,840,178 B2 * 1/2005 Collins et al. ..... 102/476
7,011,027 B2 * 3/2006 Reese et al. ..... 102/307
7,261,036 B2 * 8/2007 Bourne et al. ..... 102/306
7,278,354 B1 * 10/2007 Langan et al. ..... 102/306
7,287,589 B2 * 10/2007 Grove et al. ..... 166/297
2003/0037692 A1 * 2/2003 Liu ..... 102/301
2003/0183113 A1 * 10/2003 Barlow et al. ..... 102/476
2004/0200377 A1 * 10/2004 Collins et al. ..... 102/476
2005/0115488 A1 * 6/2005 Westby ..... 116/200
2005/0188878 A1 * 9/2005 Baker et al. ..... 102/306
2007/0053785 A1 * 3/2007 Hetz et al. ..... 419/42
2007/0056462 A1 * 3/2007 Bates et al. ..... 102/476
2007/0107616 A1 * 5/2007 Grove et al. ..... 102/306
2007/0158109 A1 * 7/2007 Zazovsky et al. ..... 175/4.6
2007/0214991 A1 * 9/2007 Ronn et al. ..... 102/306
2007/0227390 A1 * 10/2007 Palmateer ..... 102/476
2007/0295235 A1 * 12/2007 Walton et al. ..... 102/307

* cited by examiner

*Primary Examiner*—Michael Carone
*Assistant Examiner*—Michael D David
(74) *Attorney, Agent, or Firm*—Kevin Brayton McGoff; Rodney Warfford

(57) ABSTRACT

A perforating charge for use in a wellbore includes an explosive and a liner to be collapsed by detonation of the explosive. The liner includes at least a first liner portion and a second liner portion which have different cohesiveness.

2 Claims, 3 Drawing Sheets

PERFORATING CHARGE FOR USE IN A WELL

CROSS-REFERENCE TO RELATED APPLICATIONS

This application is a divisional of application Ser. No. 11/559,243 filed Nov. 13, 2006 which is pending and which also claims the benefit under 35 U.S.C. §119(e) of U.S. Provisional Application Ser. No. 60/736,516, filed Nov. 14, 2005, which is hereby incorporated by reference.

TECHNICAL FIELD

The present invention relates generally to perforating tools used in downhole applications, and more particularly to a method and apparatus for use in improving perforation operations in a wellbore.

BACKGROUND

After a well has been drilled and casing has been cemented in the well, one or more sections of the casing, which are adjacent to formation zones, may be perforated to allow fluid from the formation zones to flow into the well for production to the surface or to allow injection fluids to be applied into the formation zones. A perforating gun string may be lowered into the well to a desired depth and the guns fired to create openings in the casing and to extend perforations into the surrounding formation. Production fluids in the perforated formation can then flow through the perforations and the casing openings into the wellbore.

Typically, perforating guns (which include gun carriers and shaped charges mounted on or in the gun carriers) are lowered through tubing or other pipes to the desired well interval. Shaped charges carried in a perforating gun are often phased to fire in multiple directions around the circumference of the wellbore. When fired, shaped charges create perforating jets that form holes in surrounding casing as well as extend perforations into the surrounding formation.

Various types of perforating guns exist. One type of perforating gun includes capsule shaped charges that are mounted on a strip in various patterns. The capsule shaped charges are protected from the harsh wellbore environment by individual containers or capsules. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. Upon firing, the shaped charge emits sufficient energy in the form of a high-velocity high-density jet to perforate the hollow carrier (or cap, in the case of a capsule charge) and subsequently the casing and surrounding formation.

An issue associated with use of shaped charges is how effective the shaped charges are in penetrating the surrounding casing and formation. Most conventional shaped charges used in wellbore environments employ powdered metal liners. However, an issue associated with such powdered metal liners is reduced impact pressure, which can cause reduced penetration effectiveness.

SUMMARY

In general, according to an embodiment, a perforating charge has a liner containing a layer having at least a first portion and a second portion, where the first portion and second portion have different cohesiveness characteristics.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
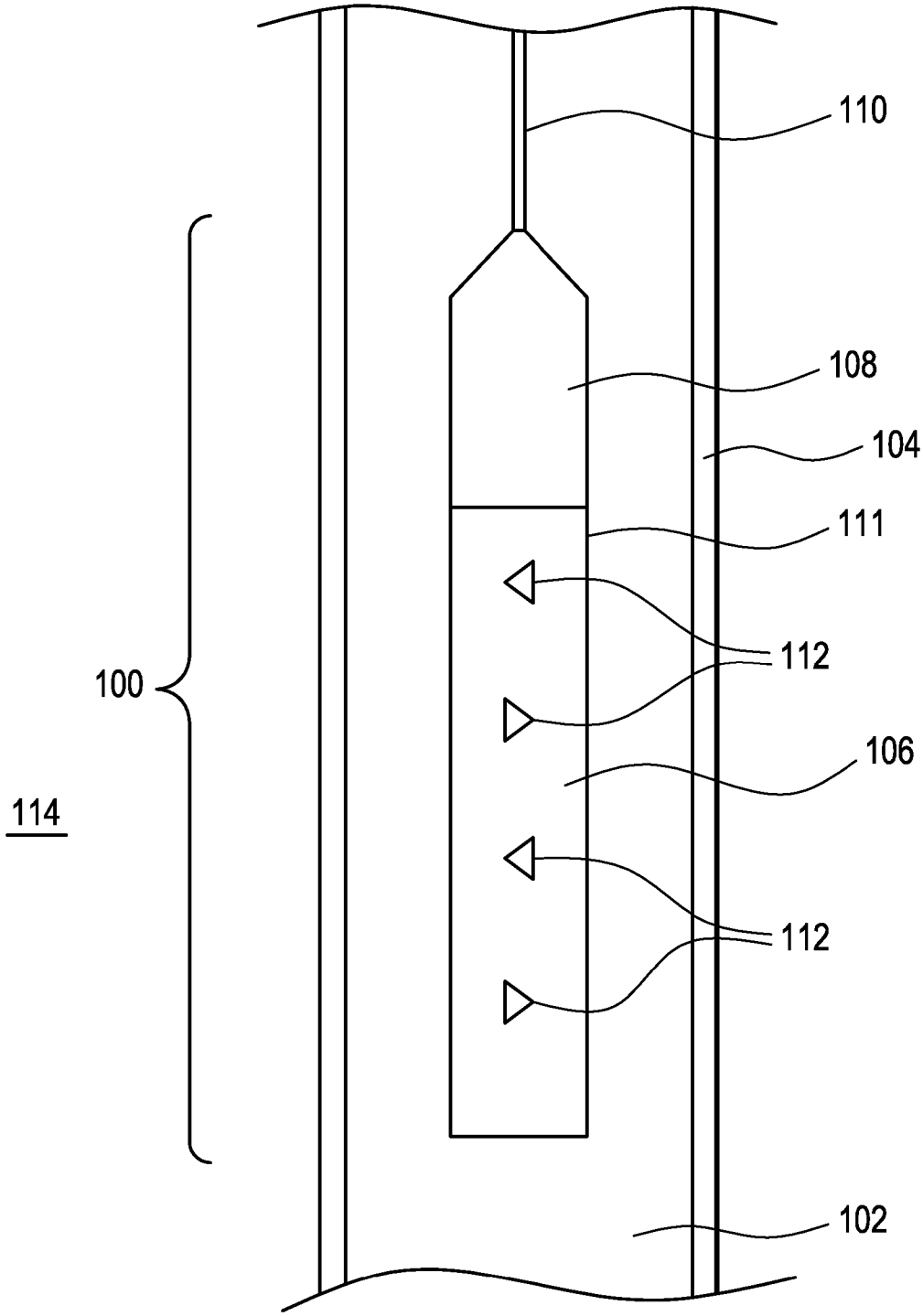
FIG. 1 illustrates an example tool string positioned in a wellbore, where the tool string incorporates perforating charges according to an embodiment.

FIG. 1 illustrates an example tool string 100 that has been lowered into a wellbore 102, which is lined with casing 104. The tool string 100 includes a perforating gun 106 and other equipment 108, which can include a firing head, an anchor, a sensor module, a casing collar locator, and so forth, as examples. The tool string 100 is lowered into the wellbore 102 on a carrier line 110, which carrier line 110 can be a tubing (e.g., a coiled tubing or other type of tubing), a wireline, a slickline, and so forth.

The perforating gun 106 has perforating charges that are in the form of shaped charges 112, according to some embodiments. The shaped charges 112 are mounted on or otherwise carried by a carrier 111 of the perforating gun 106, where the carrier 111 can be a carrier strip, a hollow carrier, or other type of carrier. The shaped charges can be capsule shaped charges (which have outer protective casings to seal the shaped charges against external fluids) or non-capsule shaped charges (without the outer sealed protective casings).

Each shaped charge 112 has a liner formed of a layer having at least two portions, where the at least two portions include a first portion having a relatively high cohesiveness (e.g., solid metal) and a second portion having a relatively low cohesiveness (e.g., powdered metal).

More generally, a perforating charge according to some embodiments includes a liner having at least one layer formed of plural portions that have different cohesiveness. Using a liner having a layer with at least two different portions of different cohesiveness allows for the ability to tailor the characteristic of the perforating jet that results from collapsing the liner in response to detonation of an explosive in the perforating charge. In one application, it is desired that the perforating jet has greater impact pressure, while the perforating jet maintains a desired velocity and length. The greater impact pressure and desired velocity and length characteristics increase penetration effectiveness (e.g., increased penetration depth into surrounding formation 114) of the perforating jet resulting from detonation of the perforating charge.

Generally, perforating charges according to some embodiments provide increased penetration depth by increasing the effective density of the perforating jet (such as by increasing the effective density in the tail region of the perforating jet). This may be done by constructing the liner with a layer having the following portions: (1) a powdered metal main liner portion, and (2) a solid metal liner base portion.

Perforating charges conventionally contain liners fabricated from finely-powdered metal. Experimental evidence suggests that these jets, upon stretching, distend to very low macroscopic densities, particularly in the tail region. However, a low-density jet penetrates less effectively than a high-density jet of equal velocity. Therefore, increasing jet density (while maintaining its velocity) would increase penetration effectiveness. One way to increase jet tail density is to replace the liner skirt or base region (that which produces the jet tail) with a solid material.

The solid liner base portion of the liner forms a jet tail with some strength, whose diameter decreases as its length increases, maintaining full solid density. The resulting jet includes a powdered "front" region of variable density, followed by a solid "tail" or "aft" region of relatively high effective density. Such a perforating jet is illustrated in FIG. 3. However, before discussing FIG. 3, reference is first made to FIG. 2.

Figure 2:
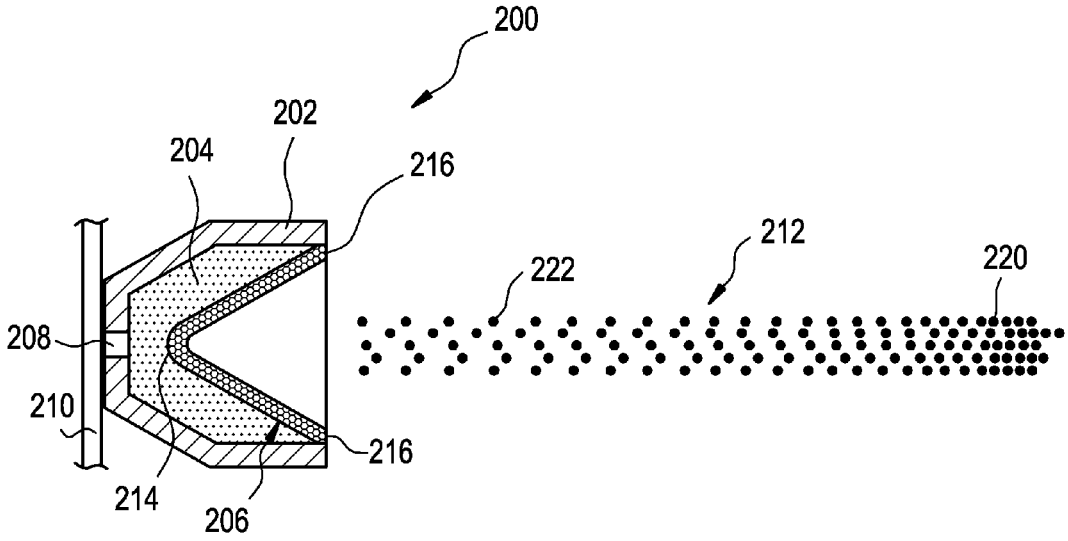
FIG. 2 PRIOR ART
FIG. 2 is an enlarged cross-sectional view of a conventional shaped charge.
Figure 3:
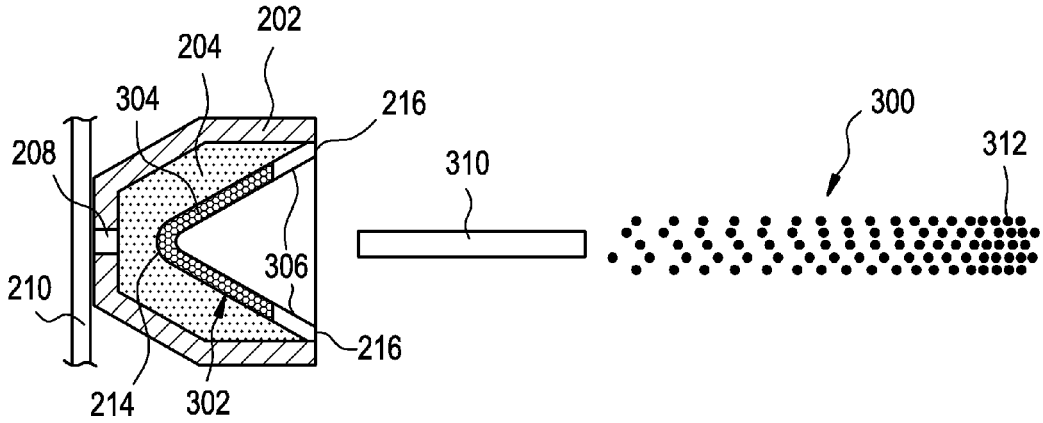
FIG. 3 is an enlarged cross-sectional view of a shaped charge having a liner according to an embodiment of the present invention.

FIG. 2 depicts a conventional shaped charge 200 that has an outer case 202 that acts as a containment vessel designed to hold the detonation force of the detonating explosion long enough for a perforating jet to form. Common materials for the outer case 202 include steel or some other metal. The main explosive charge 204 of the shaped charge 200 is contained inside the outer case 202 and is sandwiched between the inner wall of the outer case 202 and the outer surface of a liner 206. A primer column 208 is a sensitive area at the rear of the shaped charge that provides the detonating link between the main explosive charge 204 and a detonating cord 210, which is attached to the rear of the shaped charge 200.

To detonate the shaped charge 200, a detonation wave traveling through the detonating cord 210 initiates the primer column 208 when the detonation wave passes by, which in turn initiates detonation of the main explosive charge 204 to create a detonation wave that sweeps through the shaped charge 200. The liner 206 collapses under the detonation force of the main explosive charge 204. Material from the collapsed liner 206 forms a perforating jet 212 that shoots through the front of the shaped charge 200.

During initiation of the shaped charge, the detonating explosive charge 206 exerts enormous pressure (hundreds of thousands of atmospheres) on the liner, which collapses to form the jet 212, which travels forward (away from the explosive charge 206) at high velocity. This high velocity (often 1 to 10 kilometers per second) jet impacts the target (e.g., casing 104 and formation 114), producing very high impact pressures. If the impact pressures are sufficiently high (relative to the target strength), target material is displaced, and the desired perforation tunnel is produced.

Depending on the charge design, the liner collapses more-or-less sequentially starting at near the apex (214) and ending near the base (216), at a constantly-changing angle and velocity. This results in a velocity gradient along the jet, where the "tip" 220 (the first part formed) travels faster than the "tail" 222 (the last part formed). Therefore, the jet stretches, or lengthens, as it travels toward the target.

Jet-target impact pressure can be approximated by applying Bernoulli's solution of stagnation pressure in streamline flow. Dynamic pressure is proportional to jet density and jet velocity squared. If this pressure greatly exceeds target strength, then strength can be neglected, and the impact is considered hydrodynamic. In this case, penetration depth (normalized to unit jet length) is proportional to the square root of the ratio of jet-to-target densities (independent of velocity). This is the reason for the selection of high-density metals (e.g., copper, tantalum, tungsten) for liners. If, however, the impact pressure only marginally exceeds target strength, then penetration depth depends on jet velocity and target strength as well.

Jets formed from powdered metal liners (used in many conventional shaped charges) may distend to very low macroscopic densities (as low as approximately $1/10^{th}$ of the density of the compacted liner) upon stretching. On a small enough scale, it can be observed that these jets contain millions of discrete particles (the constituent powder) separated by relatively large gaps, and so could conceivably be treated analogously to solid-liner jets. However, on the macroscopic scale, it is more convenient to consider the powdered jet as continuous, low-density, and highly-compressible.

Neglecting compressibility, low jet density implies reduced impact pressure. However, when compressibility is considered, the jet formed from a powdered metal liner may compress to full density upon impact, but in doing so, decelerates; the reduced velocity implies reduced impact pressure. So, whether or not jet compressibility is considered, a low-density jet tail (222), as produced with the conventional shaped charge, produces lower impact pressure (and reduced penetration effectiveness) than would a fully-dense jet tail of equal velocity and length produced by a shaped charge according to some embodiments, such as the one depicted in FIG. 3.

Therefore, in accordance with some embodiments, increasing jet tail density (while maintaining velocity and length) would increase penetration effectiveness. As depicted in FIG. 3, for a liner 302 that includes a powdered metal portion 304, a way to increase jet tail density is accomplished by replacing the liner skirt (or base) region (that which produces the jet tail) with a solid metal, thus forming a solid metal base portion 306. The liner skirt (or base) region is the region of the liner proximate the base 216 of the liner 302.

More generally, the liner 302 according to some embodiments has a first liner portion 304 that has a cohesiveness that is less than the cohesiveness of a second liner portion 306. In the example embodiment discussed above, the first liner portion 304 is formed of a finely-powdered metal, whereas the second liner portion 306 is formed of a solid metal. Note that the powdered metal and solid metal can either be the same metal or different metals, with examples being copper, tantalum, tungsten, and so forth. Thus, according to some implementations, the powdered metal can be one of powdered copper, powdered tantalum, and powdered tungsten, while the solid metal can be one of solid copper, solid tantalum, and solid tungsten.

Also, note that the first liner portion 304 and second liner portion 306 are part of the same layer in the liner. The first liner portion 304 includes the apex of the liner 302, whereas the second liner portion 306 includes the base 216 of the liner 302.

The liner 302 is collapsed by detonation of the explosive charge 204 to form a perforating jet 300 that has tail region 310 and a front region 312. The solid metal liner base portion 306 forms the jet tail region 310 with some strength, whose diameter therefore decreases as its length increases, maintaining full solid density. The front region 312 of the perforating jet 300 has variable density, as the front region 312 is formed from the powdered metal liner portion 304. The tail region 310 of relatively high effective density is thus able to achieve a superior penetration depth.

In an alternative embodiment, the first liner portion 304 can have a higher cohesiveness than the second liner portion 306. In this alternative embodiment, the first liner portion 304 can be formed of solid metal, and the second liner portion 306 can be formed of a powdered metal, according to an example.

In the discussion above, it is assumed that the plural liner portions of different cohesiveness are part of a single layer in the shaped charge. Note, however, that in some embodiments, the liner can have multiple layers, where at least one of the multiple layers has the plural liner portions of different cohesiveness.

FIG. 3 depicts a generally conical liner that is used as a deep penetrator (to form a perforating tunnel in surrounding formation having a relatively deep penetration depth). However, in other embodiments, techniques of using multiple portions of different cohesiveness in a layer of a liner can be applied to non-conical shaped charges as well, such a pseudo-hemispherical, parabolic, or other similar shaped charges. Non-conical shaped charges are designed to create large entrance holes in casings. Such shaped charges are also referred to as big hole charges.

Figure 4:
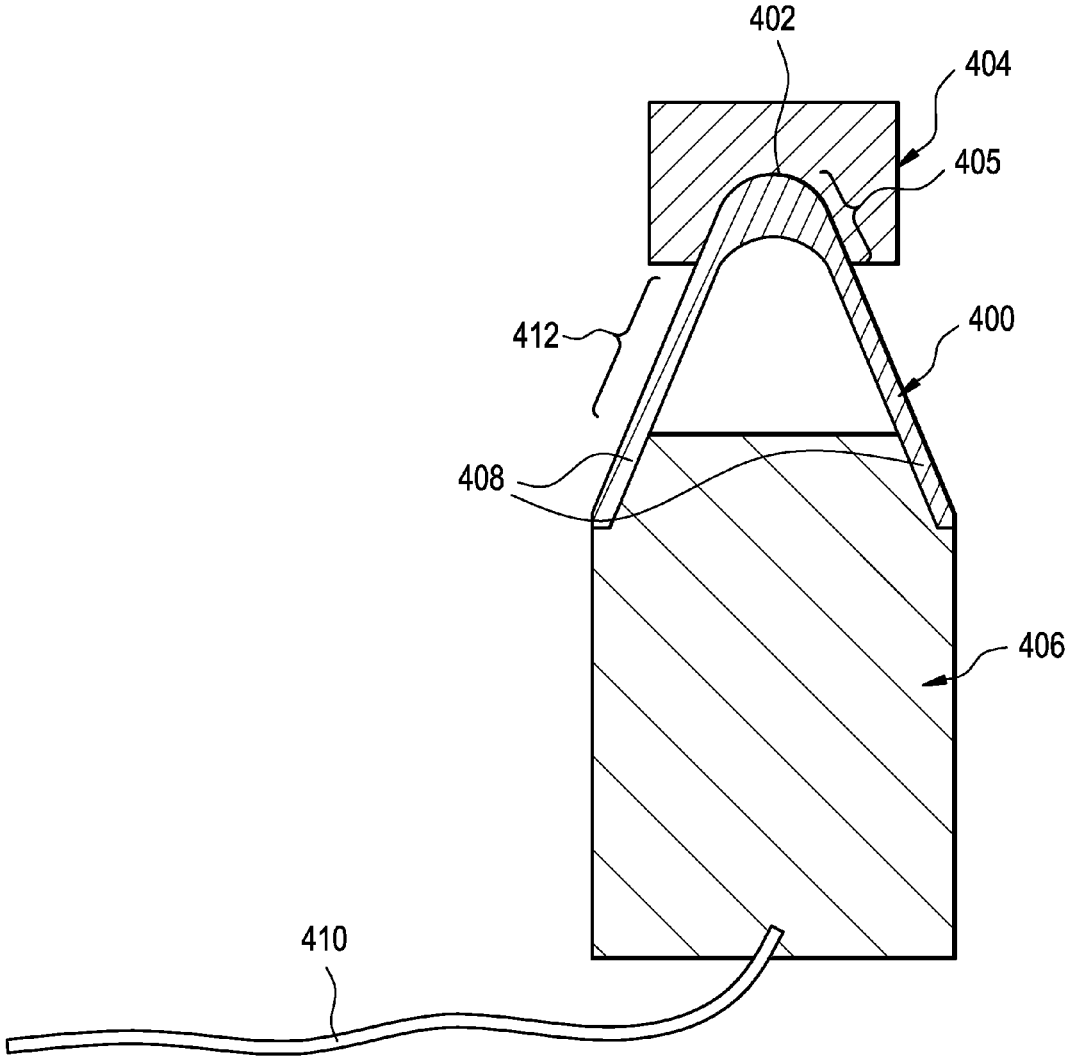
FIG. 4 illustrates an arrangement used for making a liner according to an embodiment.

Various techniques according to some embodiments can be used to form the multi-portioned liner layer according to some embodiments. As depicted in FIG. 4, a liner 400 that is initially formed of a powdered material has its apex 402 in contact with a cold block 404 (to maintain a low temperature in the region of the liner 400 adjacent the apex 402). The cold block 404 can be part of a refrigeration unit. As depicted in FIG. 4, the cold block 404 is in thermal contact with an apex region 405 of the liner 400.

In addition, FIG. 4 shows a heater 406 that is thermally contacted to a base region 406 of the liner 400. The heater 406 is attached to an electrical cable 410 for electrically activating the heater 406. Note that the base region 408 of the liner 400 is initially formed of a powdered material, just like the rest of the liner 400.

By activating the heater 406, local sintering of the base region 408 is performed to convert the powdered material into a solid material (such as to convert powdered metal to solid metal). The cold block 404 that is in contact with the region adjacent the apex 402 of the liner 400 enables a steep thermal gradient to be established across the liner 400, such that sintering does not occur in the region proximate the apex 402 of the liner 400. A transition region 412 exists between the apex region 405 and the base region 408, where some sintering may occur in the transition region 412 due to transfer of heat from the heater 406 to the transition region 412.

In accordance with another embodiment, a different technique of forming a liner having a layer with multiple portions having different cohesiveness is to first fabricate a powdered material liner. Then, the base region of the liner can be cut off such that a main liner portion is left. A separate base liner portion is then fabricated, where the base liner portion is formed of a solid material. The main liner portion and the base liner portion are then pieced together (the base liner portion abutted to the main liner portion) to form the layer having two different portions. Note that the powdered material liner portion and solid material base portion are bonded to the explosive charge (explosive charge 204 in FIG. 3) so that the solid material base liner portion does not have to be bonded directly to the powdered material liner portion.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method of making a liner for a perforating charge, comprising: forming a liner having a concave shape opening up in a first direction, an apex, and a base region that is most distal from the apex in the first direction; forming the liner to initially have a first cohesiveness; cutting a segment of the liner such that a first portion including the apex having the first cohesiveness remains; forming a second portion including the base that has a second cohesiveness that is greater than the first cohesiveness; and abutting the second portion to the first portion to form the liner having the first and second portions such that the second portion continues to extend in the same direction as the first portion away from the apex.

2. The method of claim 1, further comprising contacting the first and second portions to an explosive of the perforating charge.

* * * * *